US005232520A

United States Patent [19]

Oka et al.

[11] Patent Number: 5,232,520

[45] Date of Patent: Aug. 3, 1993

[54] HIGH-STRENGTH MARTENSITIC STAINLESS STEEL HAVING SUPERIOR FATIGUE PROPERTIES IN CORROSIVE AND EROSIVE ENVIRONMENT AND METHOD OF PRODUCING THE SAME

[75] Inventors: Yutaka Oka; Shigeto Matsumoto; Kiyoshi Uchida, all of Chiba, Japan

[73] Assignee: Kawasaki Steel Corporation, Tokyo, Japan

[21] Appl. No.: 820,560

[22] Filed: Jan. 14, 1992

Related U.S. Application Data

[63] Continuation of Ser. No. 623,099, Dec. 6, 1990, abandoned.

[30] Foreign Application Priority Data

Dec. 11, 1989 [JP] Japan ..... 1-318952
Dec. 14, 1989 [JP] Japan ..... 1-322728
Dec. 14, 1989 [JP] Japan ..... 1-322729

[51] Int. Cl.[5] ..... C21D 8/00

[52] U.S. Cl. ..... 148/542; 148/325; 148/327; 148/609; 420/69

[58] Field of Search ..... 148/12 E, 135, 325, 148/327; 420/69

[56] References Cited

FOREIGN PATENT DOCUMENTS 13028 1/1984 Japan ..... 148/12 E
1127620 5/1989 Japan ..... 148/12 E

*Primary Examiner*—R. Dean
*Assistant Examiner*—Sikyin Ip
*Attorney, Agent, or Firm*—Bierman and Muserlian

[57] ABSTRACT

A high strength martensitic stainless steel having superior anti-fatigue characteristics when used in a corrosive or erosive environment. The steel has a proof strength of 80 to 110 kg/mm$^2$ and a composition containing specified amounts of carbon, silicon, manganese, chromium, nickel, molybdenum, vanadium, and nitrogen, the balance being substantially iron and incidental inclusions. The contents of the additives are such that a nickel equivalent Nieq given by the following Formula (1) ranges between 10.5 and 12.9 wt. %:

$$Nieq=[Ni]+[Mn]+0.5[Cr]+0.3\,[Si]+[Mo] \quad (1)$$

where, [Ni], [Mn], [Cr], [Si], and [Mo], respectively represent the contents of Ni, Mn, Cr, Si, and Mo, respectively. The steel may also contain niobium or copper. The steel is produced by a process which includes a hot work and a subsequent cooling at a specific cooling rate to a specific temperature range.

12 Claims, 4 Drawing Sheets

HIGH-STRENGTH MARTENSITIC STAINLESS STEEL HAVING SUPERIOR FATIGUE PROPERTIES IN CORROSIVE AND EROSIVE ENVIRONMENT AND METHOD OF PRODUCING THE SAME

PRIOR APPLICATION

The present application is a continuation of U.S. patent application Ser. No. 623,099 filed Dec. 6, 1990, now abandoned.

BACKGROUND OF THE INVENTION

1. Field of the Invention

The present invention relates to a martensitic stainless steel suitable for use as a material of members which operate at high speed in water, such as foils and struts of a high speed vessel, e.g., a hydrofoil, runner of a water turbine, and so forth. More particularly, the present invention is concerned with a martensitic steel which is superior in strength, corrosion resistance, erosion resistance, fatigue properties and weldability, as well as an advantageous method for producing such a steel.

2. Description of the Related Art

In recent years, speed of vessel is becoming higher, as well as operation speed of high-speed rotation members such as a water turbine runner. This has given a rise to the demand for higher corrosion and erosion resistances of the steel.

In particular, foils and struts of high-speed vessel such as a hydrofoil are required to have high strength partly because they are required to bear the weights of cargo, passengers and the hull and partly because they must be constructed to have a reduced weight to reduce the total weight. In addition, the whole or part of the load is applied repeatedly to the struts and foils as a result of rolling and pitching of the vessel. The frequency of application of such a repetitious load is not so high as that in the case of a propeller or a water turbine. In addition, the foils and struts are used in sea water. Therefore, the steel used as a material for such a hydrofoil is required to have high strength against low cyclic frequency fatigue load in sea water, as well as high resistances to corrosion and erosion which are caused by sea water which attacks the foils and struts at high relative velocity.

In order to cope with these demands, Ni-containing steels containing 13 wt % of Cr and 3 to 5 wt % of Ni have been used. As disclosed in Japanese Patent Publication No. 42-16870, this type of steel has been produced by cooling the steel after full-austenization, followed by a tempering at 550° to 650° C. so as to allow formation of 15 to 40 wt % of retained austenite. This type of steel exhibits a proof strength of 60 to 70 kgf/mm$^2$, as well as good toughness.

Martensitic stainless steels generally exhibit inferior weldability and workability as compared with austenitic stainless steel. A steel ASTM CA6NM (13Cr-4Ni), has been developed as cast steel material of having section structure. However, cast steel products in general exhibit quite inferior resistance to erosion because of casting defect. Furthermore, existence of internal casting defect impairs the soundness of the whole product. In order to obviate this problem, Japanese Patent Laid-Open Publication No. 1-127620 discloses a method of producing a martensitic stainless steel employing a hot rolling step. More specifically, in this method, a cast martensitic stainless steel is subjected to hot rolling so as to extinguish any casting defect, thereby greatly reducing any degradation in the resistance to erosion and in fatigue strength. This steel, however, exhibits a proof strength of 60 to 70 kgf/mm$^2$ at the greatest, which is still unsatisfactory.

The current demand for higher speed of high-speed boats requires the weight of the foils and struts to be reduced. There also exists a demand for higher operational speed of rotary machines such as a runner of a water turbine. Under these circumstances, there is an increasing demand for high-strength martensitic stainless steel having a proof strength of 80 kgf/mm$^2$ or greater. In general, steels having greater strength exhibit inferior weldability, as well as lower fatigue strength and resistance to erosion. Therefore, it has been difficult to obtain a high strength without being accompanied by impairment in the characteristics such as weldability, resistances to erosion and corrosion and fatigue strength.

A steel called 17-4PH steel has been known as an example of a high-strength stainless steel having a proof strength of 80 kgf/mm$^2$ or greater. In the production of this steel, precipitation hardening heat treatment is necessary to precipitate carbides and Cu so as to attain a high proof strength. When this precipitation hardening type high-strength steel is subjected to a welding, however, the precipitates are dissolved again in the weld region due to heat applied during welding, resulting in a reduction in the strength. In order to obtain a desired strength, therefore, the welded structure has to be subjected again to a precipitation hardening treatment. Thus, the known steels of the type described require cumbersome heat treatment repeatedly after welding. Further, when the welded structure is large in size, for applying such a heat treatment after welding, a large-size heat-treating furnace is required.

Japanese Patent Laid-Open Publication No. 62-124218 discloses a method of producing a high-strength stainless steel in which contents of alloy elements such as Ni and Mn are adjusted to keep the Ms point near the level of the room temperature, and annealing is conducted at a specific temperature range for a specific time, thereby attaining a high workability and high weld-softening resistance. Japanese Patent Laid-Open Publication No. 62-124218, however, does not mention at all any measure for improving fatigue properties of the steel in corrosive or erosive condition. In addition, use of large amounts of alloy elements is uneconomical, and there is an increasing demand for a high-strength stainless steel which do not require addition of large quantity of alloy elements.

Japanese Patent Publication No. 61-23259 discloses stainless steel which exhibits superior ductility at the weld region and corrosion resistance due to formation of a massive martensitic structure at the weld region by virtue of adjustment of the contents of elements such as C, N, Cr and Ni. Japanese Patent Publication No. 61-23259, however, does not mention at all fatigue characteristic of the steel in corrosive and erosive condition, as well as the strength level of the material, although a description is made as to corrosion resistance, bending characteristic and toughness of the weld region formed by the use of a 410 Nb welding rod. The adjustment of alloy-element contents, particularly the amount of Al, in Japanese Patent Publication No. 61-23259 differs from the present invention in which the adjustment of these contents is intended to improve the fatigue strength of the material in sea water.

Japanese Patent Publication Nos. 2-243739 and 2-243740 disclose methods of producing steel suitable for use in oil and gas wells, through specific adjustment of elements such as C, N, Cr, Ni, Nb and V. Steels produced by the methods disclosed in these publications exhibit improved corrosion resistance under corrosive conditions containing carbon dioxide gas, hydrogen sulfide and chloride ions. These publications, however, do not mention at all improvement in fatigue properties of the steels when used in corrosive conditions to which the present invention is directed. In particular, these publications do not at all mention the effect of addition of Cu which is proposed by the present invention and which produces a significant effect in improving fatigue properties in sea water. Furthermore, these publications fail to mention proof strength which is a significant factor in structural designs. Thus, none of the prior art references mentioned above provide any idea for attaining an improvement in low cyclic frequency fatigue properties in sea water to which the present invention pertains.

SUMMARY OF THE INVENTION

Accordingly, an object of the present invention is to provide a high-strength martensitic stainless steel which has a proof strength of 80 to 110 kgf/mm$^2$ or greater and which is superior in resistances to corrosion and erosion, fatigue properties in sea water and weldability, as well as a method for producing such a steel.

The present inventors have conducted an intense study for the purpose of attaining a higher strength of martensitic stainless steels and have found that, in order to attain a higher strength without reducing corrosion resistance, it is most important to prevent precipitation of coarse carbides in the grain boundaries.

The inventors also have found that prevention of such carbides can effectively be suppressed and, hence, corrosion resistance and weldability are improved, by optimizing the contents of elements such as C, N, Cr and Ni and also by the addition of elements such as Mo and V. The present inventors also have found that fatigue failure at low cyclic frequency loading cycle in sea water is triggered by a pit formed by corrosion at the surface of the steel, and that low cyclic frequency fatigue strength in sea water is improved by a reduction in the impurities such as $Al_2O_3$. Furthermore. the present inventors have discovered that addition of Nb is effective in improving strength, while addition of Cu and Mo is effective in improving fatigue properties in sea water. The inventors further found that a finer structure and, hence, an improved strength is obtainable by conducting tempering subsequent to a hot rolling conducted under specific conditions. More specifically, the inventors have found that a greater strength is obtained when the temperature at which the hot rolling is finished is chosen in the moderate range and the rate of a subsequent cooling is preferably controlled.

The present invention has been accomplished with these knowledge.

According to one aspect of the present invention, there is provided a high-strength martensitic stainless steel having superior fatigue properties when used in a corrosive or erosive environment, the stainless steel possessing a proof strength of 80 to 110 kgf/mm$^2$ and having a chemical composition containing: 0.005 to 0.04 wt % of C, not more than 1.0 wt % of Si, not more than 2.0 wt % of Mn, 12.0 to 17.0 wt % of Cr, 3.0 to 6.0 wt % of Ni, 0.1 to 1.5 wt % of Mo, 0.02 to 0.5 wt % of V and 0.005 to 0.02 wt % of N, and the balance substantially Fe and incidental inclusions, the contents of C, Si, Mn, Cr, Ni, Mo, V and N being determined such that an Ni equivalent Nieq given by the following formula (1) ranges between 10.5 and 12.9 wt %:

$$Nieq=[Ni]+[Mn]+0.5[Cr]+0.3[Si]+[Mo] \quad (1)$$

where, [Ni], [Mn], [Cr], [Si] and [Mo] respectively represent the contents of Ni, Mn, Cr, Si and Mo in weight %.

According to another aspect of the present invention, there is provided a method of producing a high-strength martensitic stainless steel possessing a proof strength of 80 to 110 kgf/mm$^2$ and having superior fatigue properties when used in a corrosive or erosive environment, comprising the steps of: preparing a steel having a composition containing: 0.005 to 0.04 wt % of C, not more than 1.0 wt % of Si, not more than 2.0 wt % of Mn, 12.0 to 17.0 wt % of Cr, 3.0 to 6.0 wt % of Ni, 0.1 to 1.5 wt % of Mo, 0.02 to 0.5 wt % of V, 0.005 to 0.02 wt % of N, one or both of 0.01 to 0.5 wt % of Nb and 0.2 to 2.0 wt % of Cu, and the balance substantially Fe and incidental inclusions, the contents of C, Si, Mn, Cr, Ni, Mo, V, N, Nb and Cu being determined such that an Ni equivalent Nieq given by the following formula (1') ranges between 10.5 and 12.9 wt %:

$$\mathrm{Nieq}=[\mathrm{Ni}]+[\mathrm{Mn}]+0.5[\mathrm{Cr}]+0.3[\mathrm{Si}]+[\mathrm{Mo}]+[\mathrm{Cu}] \quad (1')$$

where, [Ni], [Mn], [Cr], [Si], [Mo] and [Cu] respectively represent the contents of Ni, Mn, Cr, Si, Mo and Cu in weight % respectively comprising subjecting the steel to a heating to a temperature of 1250° C. at the maximum; subjecting the heated steel to a hot rolling at a final rolling temperature of not less than 800° C.; cooling the hot-rolled steel to a temperature not higher than 100° C. at a cooling rate which is not smaller than the cooling rate Vc (°C./min) which is computed in accordance with the following formula (2); and subjecting the cooled steel to a tempering or a quenching-tempering treatment:

$$Vc=2\times\{[Ni]+100([C]+[N])\} \quad (2)$$

where, [Ni], [C] and [N] respectively represent the contents of Ni, V and N in the steel.

The above and other objects, features and advantages of the present invention will become clear from the following description of the preferred embodiment when the same is read in conjunction with the accompanying drawings.

DETAILED DESCRIPTION OF THE INVENTION

Figure 1:
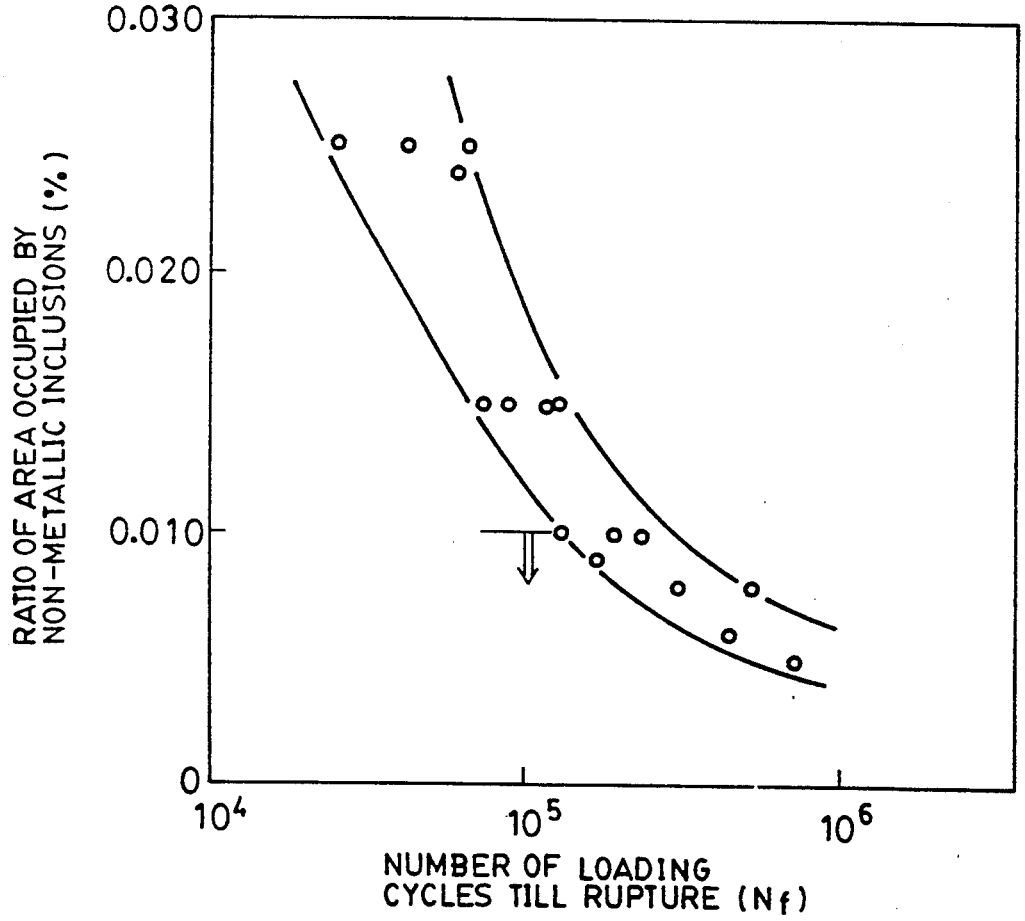
FIG. 1 is a graph showing the relationship between the ratio of area occupied by nonmetallic inclusions and the number of loading cycles till rupture as observed in a tensile fatigue test.

According to the invention, the contents of components are limited for the following reasons.

C: 0.005 to 0.04 wt %

C is an element which easily forms Cr carbides with Cr, so as to reduce the corrosion resistance. In addition, the presence of a large amount of C undesirably reduces the toughness of the steel. For these reasons, the C content is determined not to exceed 0.04 wt %. A too small C content, on the other hand, makes it difficult to maintain the required strength. For these reasons, therefore, the C content is determined not to exceed 0.005 wt %.

Si: 1.0 wt % or less

Si is an element which is essential for deoxidation and to attain an appreciable deoxidation effect, Si content is preferably determined to be 0.1 wt % or less. On the other hand, addition of Si in excess of 1.0 wt % causes a reduction in the toughness. For these reasons, the Si content is determined to be 1.0 wt % or less.

Mn: 2.0 wt % or less

Mn is an element which fixes S in the steel and which broadens the austenitic region at high temperature thereby improving hardenability. In order to obtain an appreciable effect, Mn content preferably exceeds 0.2 wt %. Addition of a too large amount of Mn, however, reduced toughness of the steel. For these reasons, therefore, the Mn content is determined to be 2.0 wt % or less.

Cr: 12.0 to 17.0 wt %

Cr is an element which is important for obtaining a high corrosion resistance while maintaining martensitic structure. These effects, however, are not appreciable when the Cr content is below 12.0 wt %. On the other hand, a Cr content exceeding 17.0 wt % allows formation of 8 ferrite when the steel is heated to a high temperature, so as to impair hot workability of the steel. For these reasons, the Cr content is determined to range from 12.0 wt % to 17.0 wt %.

Ni: 3.0 to 6.0 wt %

Ni is an element which is effective in improving corrosion resistance and toughness. These effects becomes appreciable when the Ni content is increased beyond 3.0 wt % so that this content value is determined to be the lower limit of the Ni content. On the other hand, excessively large Ni content increases the amount of austenite phase after the rolling or hardening, resulting in a reduction in the strength. For this reason, the upper limit of the Ni content is set at 6.0 wt %.

Mo: 0.1 to 1.5 wt %

Mo improves corrosion resistance and is effective in improving strength because it forms fine carbides in tempering. In order to obtain these effects, the Mo content should be at least 0.1 wt %. A too large Mo content, however, undesirably reduces the hot workability. For these reasons, the upper limit of the Mo content is set at 1.5 wt %.

V: 0.02 to 0.5 wt %

V is an element which forms carbides with C and causes precipitation of such carbides in grains, thus offering a remarkable effect in improving the strength. This element also remarkably improves the resistance to softening of tempered martensite. These effects become appreciable when the V content is increased beyond 0.02 wt %. Consequently, the lower limit of V content is set at 0.02 wt %. Conversely, a too large V content undesirably reduces the toughness so that the upper limit of V content is set at 0.5 wt %.

N: 0.005 to 0.02 wt %

N is an element which is effective in attaining high strength. Unlike C, N exhibits only a small tendency for formation of Cr nitrides in the grain boundaries. It is therefore preferred to positively add N to attain a higher strength. This element, however, is liable to generate blow holes when welded by electron-beam welding. The upper N content, therefore, is determined to be 0.02 wt % or less.

C+N:

The total content of C and N should be determined to be 0.05 wt % or less, since the risk of weld cracking is enhanced when the total content of C and N exceeds this value.

Nb: 0.02 to 0.5 wt %

Nb causes precipitation of carbides in grains with C. This suppresses precipitation of coarse carbides in the grain boundaries so as to improve strength, while remarkably retarding tempering-softening of martensite as a tempering temperature rises. The effect of addition of Nb becomes appreciable when the Nb content is increased beyond 0.02 wt %. On the other hand, a too large Nb content, particularly exceeding 0.5 wt %, causes a reduction in the hot workability so that the upper limit of Nb content is set at 0.5 wt %.

Cu is an element which is effective in improving fatigue properties in sea water. This effect, however, is not appreciable when the Cu content is 0.2 wt % or less. Conversely, addition of Cu in excess of 2.0 wt % causes a reduction in the hot workability, so that the amount of addition is set to range from 0.2 to 2.0 wt %.

According to the present invention, a nickel equivalent value Nieq, which is determined by said formula (1) in case of the first invention which employs addition of Cu and by said formula (1') in case of the second invention which employs addition of Cu, falls within the range between 10.5 and 12.9 wt %.

In order to attain a high strength, it is necessary to set the Ni equivalent Nieq to a low level so as to raise the level of the Ms point thereby reducing the retained austenite. Therefore, the upper limit of the Nieq is determined to be 12.9 wt %. On the other hand, the lower limit of the Nieq value is set to 10.5 wt % since no appreciable solid solution effect is obtained when the Nieq value is below this level.

Al: 0.010 wt % or less

Al is an element which is necessary for deoxidation. This element, however, remains in the steel in the form of $Al_2O_3$ so as to reduce the fatigue properties. The Al content of the steel, therefore, should be 0.010 wt % or less in the state after deoxidation.

Non-metallic inclusions

Satisfactory fatigue properties cannot be obtained when the ratio of area occupied by non-metallic inclusions in the section taken along the rolling direction exceeds 0.01 wt %. Therefore, non-metallic inclusions should be dispersed uniformly in such an amount that the above-mentioned ratio of the area is 0.01% or less.

A description will now be given of a correlation between the ratio of the area occupied by non-metallic inclusions and the fatigue properties.

FIG. 1 shows the result of the tensile fatigue test conducted on different steels which have chemical compositions meeting the requirement of this invention and having different values of the ratio of the area occupied by non-metallic inclusions. The tensile fatigue test was conducted by applying a stress of 400 MPa at a frequency of 1 Hz in 3.5 wt % NaCl solution. The ratio of the area occupied by non-metallic inclusions was determined by polishing a sectional surface of the steel parallel to the rolling direction, measuring the sizes and numbers of the non-metallic inclusions appearing in the polished surface through an optical-microscopic observation of 120 fields of vision at a magnification 800, and conducting an image analysis on these data. As will be seen from FIG. 1, the rate of increase in the number of the loading cycles till rupture increases as the ratio of the area occupied by the non-metallic inclusions is reduced. The number (Nf) of loading cycles till rupture is as large as $1\times10^5$ when the ratio of the area occupied by non-metallic inclusions is 0.01% or less.

A preferred method of producing the steel of the present invention comprises the steps of subjecting the steel to a heating to a high temperature which is 1250° C. at the maximum, subjecting the heated steel to hot rolling which is conducted at the final temperature of 800° C., cooling the hot-rolled steel to a cooling so as to cool the steel to a temperature not higher than 100° C. at a cooling rate Vc (°C./min) calculated by a formula (2), and subjecting the cooled steel to a tempering or quenching-tempering treatment.

Conventionally, martensitic steel has been processed by quenching-tempering. In order to obtain high corrosion resistance and toughness, however, it is preferred that a thermo-mechanical heat treatment including a hot work and a subsequent cooling is preferably executed for the reasons shown below.

Namely, the thermo-metrical heat treatment consisting in hot working and subsequent cooling effectively enhances the strength due to higher fineness of the structure than the structure obtained after ordinary quenching or annealing. In case of a steel containing Nb, in order to obtain an effective precipitation of Nb of, for example, 0.05% in the solid solution through an annealing, it is necessary that a reheating at a temperature above 1100° C. is necessary when computed in accordance with Irvine's equation of $\log[Nb][C+(12/14)N]=-(6770/T)+2.26$, where [Nb] represents the solved Nb (%) and C and N represent amounts of C and N added, assuming that C and N are respectively 0.03 wt % and 0.009 wt %. According to the invention, however, reheating to such a high temperature is not necessary because precipitation of Nb with C and N is suppressed by the rolling and subsequent cooling and a required amount of effective solved Nb which precipitates through the tempering is obtained. Although tempering is preferably conducted subsequent to the thermo-metrical heat treatment, it is possible to conduct an ordinary quenching-annealing treatment.

Figure 2:
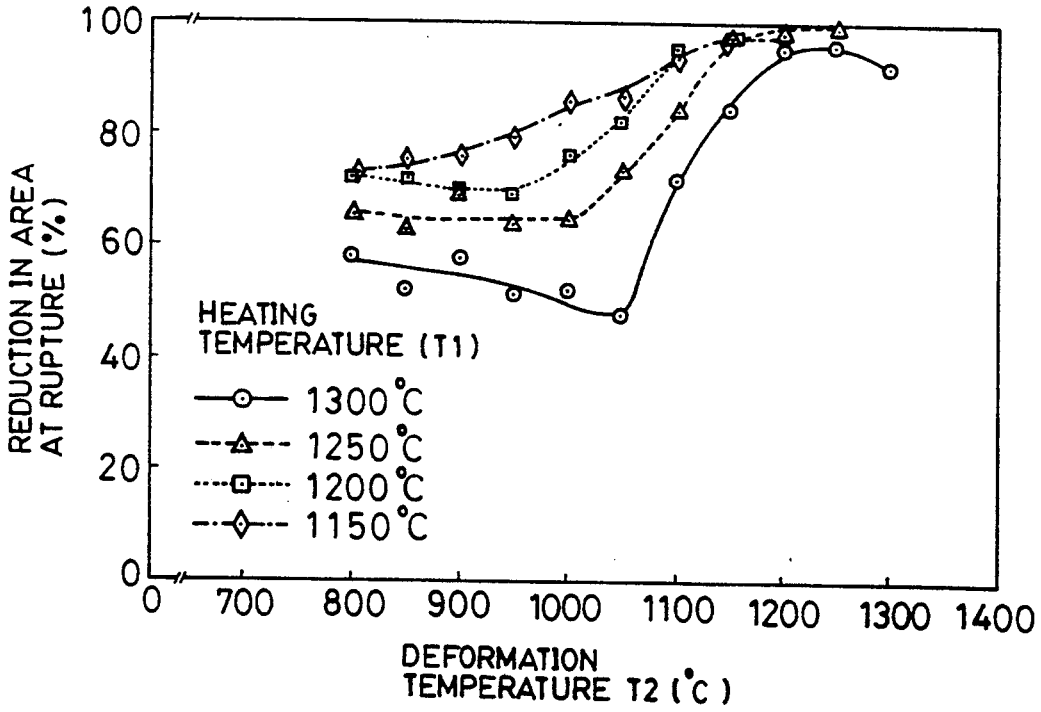
FIG. 2 is a graph showing the influence of the heating temperature on hot-workability of martensitic stainless steel.
Figure 3:
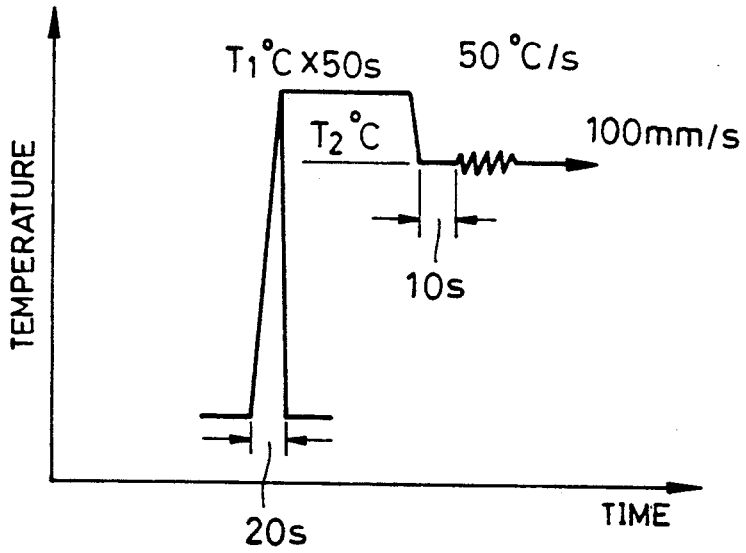
FIG. 3 is a graph showing the heating pattern in a high-temperature, high-speed tensile test.

According to the present invention, the maximum heating temperature of the steel material in advance of hot rolling is limited to 1250° C. for the following reasons. Sample steels each having a composition containing 0.03 wt % C, 0.3 wt % Si, 0.6 wt % Mn, 13.5 wt % Cr, 5.0 wt % Ni, 0.3 wt % Mo, 0.05 wt % V and 0.01 wt % Ni, were heated to different temperatures and then subjected to a high-temperature high-speed tensile test, for the purpose of examination of hot workability of these steels. The results of this test are shown in FIG. 2. The high-temperature high-speed tensile test was conducted by subjecting the steels to a temperature hysteresis as shown in FIG. 3. From FIG. 2, it will be seen that good hot workability is obtained when the steels are heated to a temperature not higher than 1250° C. Therefore, according to the present invention, the upper limit of the temperature of heating conducted prior to the hot rolling is set at 1250° C. The preferable lower limit of the heating temperature is 1100° C., from the view point of load on the rolling mill and the rolling efficiency.

The present invention does not pose any specific limitation in the rolling reduction. However, when the rolling reduction is below 10% per pass, recrystallization during hot rolling is retarded to allow local presence of coarse grain, resulting in a reduction in toughness. The rolling is therefore conducted preferably at a rolling reduction of 10% or greater per pass.

When the final temperature in the hot rolling is too low, carbides are precipitated in the hot-rolled steel so as to impair corrosion resistance of the steel. In order to obviate this problem, therefore, the finish rolling temperature in the hot rolling is limited to be not lower than 800° C.

In order to suppress precipitation of carbides in the cooling subsequent to hot rolling, the cooling is preferably conducted at a rate which is not smaller than the rate Vc given by the following formula.

$$Vc=2\times\{[Ni]+100[C]+[N])\}\ (°C./min).$$

The temperature at which the cooling is terminated should be not higher than 100° C. because the toughness of the steel is seriously impaired when the tempering subsequent to the cooling is conducted with a large amount of austenite retained in the steel after the cooling.

According to the invention, the range of the tempering temperature which enables the tempered steel to exhibit a proof strength of 80 to 110 kgf/mm$^2$ depends on the composition of the steel. When Cu and Nb are not added, the tempering temperature preferably ranges between 400° and 500° C. Namely, when the temperature is below 400° C., it is impossible to obtain a proof strength of 80 kgf/mm$^2$ or greater because such a low tempering temperature cannot cause precipitation of fine carbides. On the other hand, tempering at high temperatures exceeding 500° C. causes precipitation of coarse carbides, with the result that corrosion resistance is impaired due to precipitation of coarse carbides. When Cu and Nb are added, the tempering temperature may be raised to 650° C.

Figure 4:
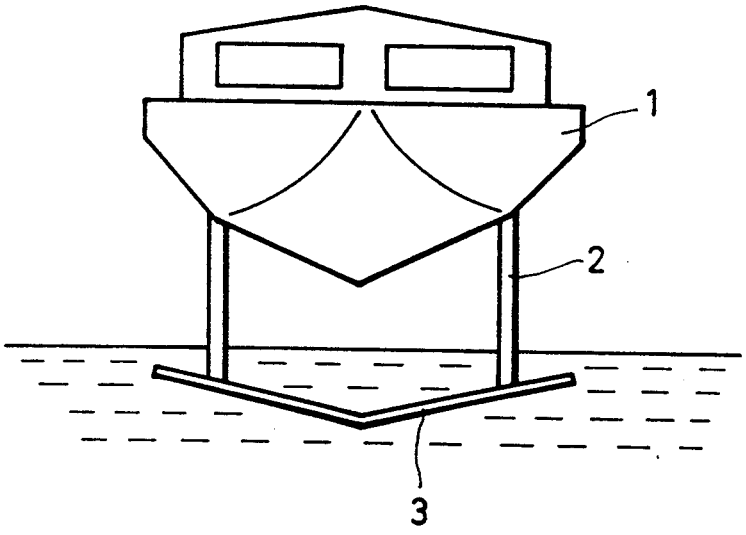
FIG. 4 is a front elevational view of a model of a hydrofoil as an example of a hydrofoil.

The high-strength martensitic stainless steel of the present invention can suitably be used as the materials for parts of a high speed vessel shown in FIG. 4, more particularly the hull 1, struts 2 supporting the hull 1 and foils 3 for generating a lift. The hull 1, struts 2 and the foils 3 constructed from the high-strength martensitic stainless steel of the present invention exhibit superior strength and high resistances both to corrosion and erosion in sea water, thus enabling a reduction in the weight of these parts and, accordingly, realizing a greater cruising speed of the boat.

A description will now be given of the reasons for the limitation of the proof strength of the steel to the range between 80 and 110 kgf/mm$^2$.

When the proof strength is below 80 kgf/mm$^2$, the effect of weight reduction is not so appreciable. On the other hand, a higher proof strength, though it contributes to a reduction in the weight, requires a greater amount of alloying elements. The use of large amounts of alloying elements is not preferred partly because it reduces weldability and partly because it raises the cost. For these reasons, the proof strength is determined to range from 80 to 110 kgf/mm$^2$.

Foils and struts are usually constructed by assembling sheets of the steel material by TIG, MIG or EBW welding. In the case of conventional 17-4PH stainless steel, it is necessary that the whole structure assembled by welding is subjected to a solid solution treatment and an aging treatment. When this known material is used, therefore, a specific consideration has to be given to the sequence of assembly and the condition of heat treatment.

In contrast, in the invention of this application, it is possible to obtain a high proof strength of 80 to 110 kgf/mm$^2$, even by a tempering treatment at high temperature. According to the present invention, therefore, it is possible to conduct the post-welding stress relieving heat treatment at a temperature of, for example, about 600° C. which is higher than that in the conventional process. Stress-relieving heat treatment conducted at such a high temperature relieves residual stress substantially completely. In addition, undesirable deformation of the whole structure in the heat treatment, which inevitably takes place in solid solution heat treatment, can be avoided, thus eliminating necessity for specific consideration which heretofore has been necessary to eliminate any influence of deformation during heat treatment.

EXAMPLE 1

Steels having the chemical compositions shown in Table 1 were prepared. Steel sheets 25 mm thick were produced through the various processes shown in Table 2 from slabs of 110 mm thick obtained from the above-mentioned steels. Mechanical properties, corrosion resistance and weldability of each of the thus produced steel sheets are shown in Table 3.

The corrosion resistance was evaluated through a corrosion test conducted with a 65% nitric acid solution. Samples marked by x are those which exhibited heavy intergranular attack. The erosion resistance was examined by using an opposing type magnetostrictive vibration cavitation erosion tester. Marks ⊙ and × are respectively given to samples exhibiting a corrosion weight loss of 15 g/(m$^2$h) or less and to samples exhibiting corrosion weight loss greater than 15 g/(m$^2$h). The strength of the weld portion was evaluated in terms of the hardness of the steel sheet surface when the welding was conducted by TIG welding method. Weldability was evaluated by so-called y-slit method. Namely, test welding was conducted after pre-heating to 120° C. and the welded samples were checked for any weld cracking. Marks ○ and × are respectively given to samples exhibiting no crack and samples exhibiting a crack or cracks. Fatigue strength was examined by conducting a uni-axial tensile fatigue test by repeatedly applying a stress of 400 MPa at a frequency of 1 Hz to the samples held in a 3.5% NaCl solution. Marks ○ and × are respectively given to samples which did not fail at the load cycles of $1\times10^5$ or more and to samples which failed within this number of load cycles.

As will be seen from Table 3, the sample steels of the present invention are superior to steels of known compositions and steels produced by known processes in terms of strength, toughness and corrosion resistance. In addition, each of the steels prepared in accordance with the present invention exhibited a strength of Hv 330 or higher at the weld region, so that the steel could be subjected to use without requiring any post-welding treatment, without any risk of insufficiently of strength.

TABLE 1

| Type of steel | Chemical composition C | Si | Mn | Cr | Ni | Mo | V | N | Nb | Cu | Al | P | S | Nieq | Vc(*1) | Remarks |
|---|---|---|---|---|---|---|---|---|---|---|---|---|---|---|---|---|
| 1 | 0.040 | 0.35 | 0.60 | 13.3 | 5.3 | 0.15 | 0.068 | 0.010 | — | — | 0.009 | 0.025 | 0.003 | 12.81 | 21 | Example |
| 2 | 0.038 | 0.35 | 0.58 | 13.0 | 5.3 | 0.40 | 0.012 | 0.010 | — | — | 0.008 | 0.020 | 0.002 | 12.78 | 20 | Example |
| 3 | 0.039 | 0.35 | 0.65 | 13.1 | 4.2 | 1.00 | 0.035 | 0.008 | — | — | 0.008 | 0.018 | 0.001 | 12.51 | 18 | Example |
| 4 | 0.040 | 0.35 | 0.40 | 13.3 | 5.0 | 0.15 | 0.015 | 0.012 | — | — | 0.007 | 0.020 | 0.002 | 12.31 | 20 | Example |
| 5 | 0.035 | 0.35 | 0.62 | 13.4 | 3.2 | 0.25 | 0.045 | 0.009 | 0.008 | — | 0.009 | 0.020 | 0.002 | 10.08 | 15 | Example |
| 6 | 0.065 | 0.30 | 0.70 | 13.6 | 5.8 | 0.20 | 0.040 | 0.02 | 0.009 | — | 0.020 | 0.023 | 0.002 | 13.59 | 29 | Comp. Ex. |
| 7 | 0.040 | 0.34 | 0.55 | 13.1 | 1.0 | 0.01 | 0.040 | 0.20 | — | — | 0.009 | 0.022 | 0.003 | 8.21 | 50 | Comp. Ex. |
| 8 | 0.030 | 0.32 | 0.51 | 13.7 | 6.5 | 0.02 | 0.007 | 0.01 | 0.015 | — | 0.010 | 0.027 | 0.001 | 13.96 | 21 | Comp. Ex. |
| 9 | 0.035 | 0.35 | 0.58 | 13.1 | 4.8 | 0.80 | 0.050 | 0.01 | 0.035 | — | 0.008 | 0.020 | 0.002 | 12.84 | 19 | Example |
| 10 | 0.025 | 0.30 | 0.40 | 12.8 | 4.6 | 0.50 | 0.045 | 0.01 | 0.040 | 0.5 | 0.005 | 0.024 | 0.002 | 12.49 | 16 | Example |
| 11 | 0.035 | 0.30 | 0.60 | 17.0 | 5.2 | 0.10 | 0.045 | 0.02 | — | — | 0.010 | 0.020 | 0.001 | 14.49 | 21 | Comp. Ex. |
| 12 | 0.045 | 0.25 | 0.58 | 10.5 | 4.2 | 0.04 | 0.050 | 0.01 | — | — | 0.020 | 0.023 | 0.002 | 10.15 | 19 | Comp. Ex. |
| 13 | 0.005 | 0.35 | 0.50 | 13.5 | 3.5 | 0.85 | 0.080 | 0.010 | 0.08 | — | 0.008 | 0.022 | 0.002 | 11.71 | 10 | Example |
| 14 | 0.035 | 0.34 | 0.60 | 12.2 | 6.0 | 0.20 | 0.050 | 0.012 | — | — | 0.008 | 0.022 | 0.003 | 12.60 | 21 | Example |
| 15 | 0.025 | 0.35 | 0.60 | 12.9 | 4.5 | 0.80 | 0.020 | 0.010 | — | — | 0.009 | 0.022 | 0.002 | 12.46 | 16 | Example |
| 16 | 0.008 | 0.35 | 0.50 | 13.0 | 2.6 | 0.90 | 0.080 | 0.15 | — | — | 0.008 | 0.022 | 0.002 | 10.61 | 37 | Comp. Ex. |
| 17 | 0.035 | 0.40 | 0.60 | 13.2 | 4.3 | 0.70 | 0.050 | 0.014 | 0.02 | — | 0.007 | 0.022 | 0.004 | 12.32 | 18 | Example |
| 18 | 0.037 | 0.35 | 0.65 | 13.4 | 4.8 | 0.60 | 0.040 | 0.010 | 0.5 | — | 0.005 | 0.022 | 0.002 | 12.86 | 19 | Example |
| 19 | 0.030 | 0.45 | 0.65 | 12.8 | 4.8 | 0.60 | 0.060 | 0.008 | — | 0.2 | 0.007 | 0.022 | 0.002 | 12.80 | 17 | Example |
| 20 | 0.025 | 0.32 | 0.60 | 12.9 | 3.2 | 0.[illegible] | 0.060 | 0.012 | — | 2.0 | 0.007 | 0.022 | 0.004 | 12.85 | 14 | Example |

(*1): Vc = 2 × {[Ni] + 100 ([C] + [N])}

TABLE 2

| Process No. | Heating temp. (°C.) | Rolling reduction per pass (%) | Hot-rolling finish temp (°C.) | Cooling rate | Cooling termination temp. (°C.) | Quenching temp. (°C.) | Tempering temp. (°C.) |
|---|---|---|---|---|---|---|---|
| 1 | 1200 | 15 | 800 | 100 | 20 | → | 450 |
| 2 | 1200 | 15 | 800 | 100 | 20 | 930 | 450 |
| 3 | 1200 | 15 | 800 | 10 | 20 | → | 450 |
| 4 | 1200 | 15 | 800 | 100 | 120 | → | 450 |
| 5 | 1200 | 15 | 750 | 100 | 20 | → | 450 |
| 6 | 1200 | 15 | 800 | 100 | 20 | → | 600 |

TABLE 2-continued

| Process No. | Heating temp. (°C.) | Rolling reduction per pass (%) | Hot-rolling finish temp (°C.) | Cooling rate | Cooling termination temp. (°C.) | Quenching temp. (°C.) | Tempering temp. (°C.) |
|---|---|---|---|---|---|---|---|
| 7 | 1200 | 15 | 800 | 100 | 100 | — | 450 |

TABLE 3

| Steel type | Process No. | 0.2% P.S. (kgf/mm²) | T.S. (kgf/mm²) | El (%) | vE₀ (kgf · m) | Corrosion resistance | Erosion resistance | Hardness of weld region (Hv) | y-slit cracking | Fatigue properties in sea water | Remarks |
|---|---|---|---|---|---|---|---|---|---|---|---|
| 1 | 1 | 95.3 | 112.3 | 19 | 12.5 | ○ | ○ | 389 | ○ | ○ | Example of Invention |
| 1 | 2 | 94.7 | 110.8 | 22 | 14.8 | ○ | ○ | 386 | ○ | ○ | Example of Invention |
| 1 | 3 | 85.4 | 95.7 | 18 | 9.0 | X | ○ | 337 | ○ | X | Known steels |
| 1 | 4 | 82.6 | 96.5 | 20 | 4.7 | ○ | ○ | 336 | ○ | ○ | Known steels |
| 1 | 5 | 97.6 | 115.7 | 21 | 8.5 | X | ○ | 402 | ○ | X | Known steels |
| 1 | 6 | 78.5 | 89.8 | 23 | 14.3 | X | X | 310 | ○ | X | Known steels |
| 2 | 1 | 97.8 | 115.5 | 21 | 11.6 | ○ | ○ | 392 | ○ | ○ | Example of Invention |
| 3 | 1 | 98.4 | 117.5 | 21 | 12.4 | ○ | ○ | 387 | ○ | ○ | Example of Invention |
| 4 | 1 | 96.1 | 115.7 | 20 | 13.5 | ○ | ○ | 385 | ○ | ○ | Example of Invention |
| 4 | 6 | 92.7 | 113.5 | 22 | 14.1 | ○ | ○ | 386 | ○ | ○ | Example of Invention |
| 5 | 1 | 96.7 | 116.4 | 21 | 12.8 | ○ | ○ | 378 | ○ | ○ | Example of Invention |
| 6 | 3 | 82.5 | 109.8 | 22 | 12.9 | X | ○ | 402 | X | X | Known steels |
| 7 | 1 | 77.5 | 94.3 | 18 | 6.7 | ○ | X | 380 | X | X | Known steels |
| 8 | 1 | 72.4 | 89.4 | 23 | 12.4 | ○ | X | 375 | ○ | ○ | Known steels |
| 9 | 1 | 98.2 | 118.4 | 22 | 13.4 | ○ | ○ | 394 | ○ | ○ | Example of invention |
| 9 | 6 | 92.1 | 104.3 | 21 | 13.6 | ○ | ○ | 360 | ○ | ○ | Example of invention |
| 10 | 1 | 87.4 | 98.1 | 21 | 13.2 | ○ | ○ | 389 | ○ | ○ | Example of invention |
| 10 | 6 | 72.4 | 85.6 | 24 | 14.3 | ○ | X | 289 | ○ | ○ | Known steels |
| 11 | 1 | 78.4 | 92.7 | 23 | 9.4 | X | X | 368 | X | X | Known steels |
| 12 | 1 | 81.3 | 94.3 | 21 | 10.3 | X | ○ | 352 | X | X | Known steels |
| 13 | 1 | 89.5 | 108.6 | 20 | 12.8 | ○ | ○ | 372 | ○ | ○ | Example of invention |
| 14 | 1 | 83.6 | 102.8 | 22 | 12.8 | ○ | ○ | 360 | ○ | ○ | Example of invention |
| 15 | 1 | 92.4 | 110.6 | 20 | 11.9 | ○ | ○ | 387 | ○ | ○ | Example of invention |
| 16 | 1 | 108.7 | 121.3 | 18 | 11.8 | ○ | ○ | 422 | ○ | ○ | Known steels |
| 17 | 1 | 92.1 | 111.6 | 20 | 13.1 | ○ | ○ | 392 | ○ | ○ | Example of invention |
| 18 | 1 | 105.3 | 115.7 | 17 | 11.9 | ○ | ○ | 403 | ○ | ○ | Example of invention |
| 19 | 1 | 89.8 | 107.6 | 20 | 13.2 | ○ | ○ | 370 | ○ | ○ | Example of invention |
| 20 | 1 | 105.9 | 119.8 | 18 | 12.0 | ○ | ○ | 412 | ○ | ○ | Example of invention |

EXAMPLE 2

A steel was melt-formed in a converter to have a composition containing 0.03 wt % C, 0.01 wt % N, 13.5 wt % Cr, 0.30 wt % Si, 0.60 wt % Mn, 0.020 wt % P and 0.004 wt % S. Using this steel as the starting material, a secondary refining was conducted in a small-sized ESR furnace under various controls of non-metallic impurities and trace elements, thus obtaining 15 types of sample steels in the form of ingots. Each of these sample steels was bloom-rolled into slabs 100 mm thick, after a 4-hour heating at 1200° C. The thus obtained slab was then subjected to a 2-hour heating at 1200° C., followed by a hot rolling into a steel sheet 30 mm thick at a rolling finish temperature of 900° C. The steel sheet thus obtained was then subjected to a tempering heat treatment conducted at 600° C. so as to become the final product. Some of the hot rolled steels, however, were subjected to a normalizing conducted at 930° C., in advance of the tempering. Each of the sample steel sheets was subjected to a tensile fatigue test for evaluation of fatigue strength in sea water, a salt spray test for the evaluation of resistance to corrosion and erosion test for evaluating erosion resistance in salt water. The results of the evaluation are shown in Table 4 together with chemical compositions of the sample steel sheets.

A description will be given of the conditions of the tests mentioned above, as well as of marks appearing in Table 4.

Fatigue properties in sea water

A tensile fatigue test was conducted by repeatedly applying a stress of 400 MPa at a frequency of 1 Hz to each sample steel sheet held in 3.5 wt % NaCl solution, and the number (Nf) of load cycles till failure was measured. A mark ⊙ is given to the samples which did not fail at the load cycles of $1\times10^5$ or more ($Nf \geqq 1\times10^5$), while a mark × is given to sample steel sheets which failed at the load cycles of less than $1\times10^5$ ($Nf<1\times10^5$).

Corrosion resistance

A 16-hour salt spray test was conducted by using 3.5 wt % NaCl solution, and the numbers of rust points per unit area ($cm^2$) were measured. Marks ⊙, ○, Δ and × are given to samples which showed 0.1 or less rust points per $cm^2$, 0.1 to 1 rust points per $cm^2$, 1 to 10 rust points per $cm^2$ and more than 10 rust points per $cm^2$, respectively, thus evaluating the corrosion resistance.

Erosion resistance

An erosion test was conducted in a 3.5 wt % NaCl solution by using an opposing type magnetostrictive vibration cavitation erosion tester under the following conditions.

Frequency: 20 KHz

Amplitude: max 25 μm

Distance between surface of specimen and end of horn: 0.5 mm

Testing time: 24 Hr

The evaluation of erosion resistance was conducted by measuring the erosion weight loss. Marks ○ and × are given to samples which showed erosion weight loss of 15 $g/m^2$ or less and samples which showed erosion weight loss exceeding 15 $g/m^2$.

As will be understood from Table 4, the steels which meet the conditions specified by the invention exhibit superior fatigue properties in sea water, resistance to corrosion and erosion, as well as high proof strength of 80 $kgf/mm^2$ or greater, as compared with comparison steels which fail to meet the conditions specified by the present invention in at least one of the factors such as the area ratio of non-metallic inclusions, C content, Ni content, Mo content, V content, Nb content, Al content and N content.

TABLE 4

| Sample No. | Steel type | Chemical composition (wt %) C | N | Si | Mn | Ni | Cr | Mo | Nb | V | Cu | Al | O | Nieq (%) |
|---|---|---|---|---|---|---|---|---|---|---|---|---|---|---|
| 1 | Example | 0.03 | 0.008 | 0.3 | 0.6 | 5.0 | 13.5 | 0.6 | ≦0.01 | 0.08 | — | 0.008 | 0.0060 | 12.84 |
| 2 | Comp. Ex. | 0.03 | 0.008 | 0.3 | 0.6 | 5.0 | 13.5 | 0.6 | ≦0.01 | 0.08 | — | 0.020 | 0.0100 | 12.79 |
| 3 | Comp. Ex. | 0.03 | 0.008 | 0.3 | 0.6 | 5.0 | 13.5 | 0.6 | ≦0.01 | 0.08 | — | 0.025 | 0.0100 | 12.79 |
| 4 | Example | 0.02 | 0.005 | 0.3 | 0.4 | 4.9 | 12.8 | 1.0 | 0.02 | 0.05 | — | 0.006 | 0.0060 | 12.79 |
| 5 | Comp. Ex. | 0.02 | 0.005 | 0.3 | 0.4 | 4.9 | 12.8 | 1.0 | 0.02 | 0.05 | — | 0.010 | 0.0075 | 12.79 |
| 6 | Comp. Ex. | 0.02 | 0.005 | 0.2 | 0.4 | 4.9 | 12.8 | 1.0 | 0.02 | 0.05 | — | 0.020 | 0.0060 | 12.79 |
| 7 | Example | 0.04 | 0.009 | 0.2 | 0.4 | 4.7 | 12.8 | 1.0 | 0.08 | 0.20 | 0.20 | 0.008 | 0.0070 | 12.76 |
| 8 | Comp. Ex. | 0.04 | 0.012 | 0.3 | 0.4 | 4.7 | 12.8 | 1.0 | 0.08 | 0.20 | 0.20 | 0.005 | 0.0100 | 12.76 |
| 9 | Example | 0.02 | 0.005 | 0.3 | 0.5 | 4.3 | 12.8 | 1.5 | 0.08 | 0.20 | — | 0.009 | 0.0070 | 12.79 |
| 10 | Example | 0.03 | 0.008 | 0.2 | 0.4 | 3.4 | 14.3 | 0.8 | 0.10 | 0.20 | 1.0 | 0.008 | 0.0060 | 12.81 |
| 11 | Example | 0.03 | 0.008 | 0.3 | 0.4 | 4.0 | 13.5 | 0.5 | 0.06 | 0.08 | 1.0 | 0.007 | 0.0070 | 12.74 |
| 12 | Comp. Ex. | 0.03 | 0.012 | 0.3 | 0.6 | 5.2 | 13.5 | 0.5 | 0.06 | 0.08 | 1.0 | 0.010 | 0.0090 | 14.14 |
| 13 | Example | 0.03 | 0.008 | 0.3 | 0.5 | 5.1 | 13.4 | 0.4 | 0.04 | 0.05 | — | 0.009 | 0.0070 | 12.79 |
| 14 | Example | 0.03 | 0.008 | 0.3 | 0.6 | 5.2 | 13.2 | 0.3 | 0.06 | 0.02 | — | 0.006 | 0.0080 | 12.79 |
| 15 | Comp. Ex. | 0.03 | 0.008 | 0.3 | 0.6 | 5.2 | 12.8 | 2.5 | 0.04 | 0.04 | — | 0.018 | 0.0060 | 14.79 |

| Sample No. | Steel class | Ratio of area occupied by non-metal inclusions | Fatigue properties in sea water | Corrosion resistance | Erosion resistance | 0.2% P.S. ($kgf/mm^2$) | T.S. ($kgf/mm^2$) | El (%) |
|---|---|---|---|---|---|---|---|---|
| 1 | Example | 0.008 | ⊙ | ⊙ | ○ | 82.0 | 97.2 | 20 |
| 2 | Comp. Ex. | 0.015 | ⊙ | Δ | ○ | 82.9 | 98.0 | 21 |
| 3 | Comp. Ex. | 0.025 | × | Δ | ○ | 82.0 | 95.8 | 21 |
| 4 | Example | 0.006 | ⊙ | ⊙ | ○ | 83.5 | 98.7 | 21 |
| 5 | Comp. Ex. | 0.015 | ⊙ | Δ | ○ | 84.2 | 99.2 | 19 |
| 6 | Comp. Ex. | 0.024 | × | Δ | ○ | 81.8 | 98.7 | 20 |
| 7 | Example | 0.008 | ⊙ | ⊙ | ○ | 97.9 | 118.9 | 20 |
| 8 | Comp. Ex. | 0.025 | × | ○ | ○ | 98.8 | 118.7 | 19 |
| 9 | Example | 0.005 | ⊙ | ○ | ○ | 103.6 | 120.1 | 19 |
| 10 | Example | 0.009 | ⊙ | ⊙ | ○ | 97.0 | 121.5 | 20 |
| 11 | Example | 0.010 | ⊙ | ⊙ | ○ | 101.9 | 120.6 | 22 |
| 12 | Comp. Ex. | 0.025 | × | ○ | ○ | 101.7 | 118.7 | 19 |
| 13 | Example | 0.005 | ⊙ | ○ | ○ | 83.0 | 95.1 | 21 |
| 14 | Example | 0.005 | ⊙ | ○ | ○ | 81.8 | 94.3 | 20 |
| 15 | Comp. Ex. | 0.005 | ⊙ | ⊙ | ○ | 104.2 | 121.8 | 12 |

As will be fully understood from the foregoing description, according to the present invention, there is provided a high-strength martensitic stainless steel which is superior in corrosion resistance, erosion resistance and fatigue properties in sea water and which enables removal of residual stress by a post-welding heat treatment alone, by virtue of the optimum selection of contents of C, N, Cr and Ni and by addition of Mo and V. Furthermore, the high-strength martensitic stainless steel of the present invention can effectively be used as a material of a welding structural member which exhibits proof strength of 80 to 110 $kgf/mm^2$. In addition, the high-strength martensitic stainless steel of the present invention can exhibit a further improvement in the strength and fatigue properties in sea water by the addition of Nb and/or Cu. Furthermore, the method of the present invention can advantageously produce high-strength martensitic stainless steel by adopting a thermo-metrical heat treatment which includes a hot work and a subsequent cooling.

What is claimed is:

1. A high strength martensitic stainless steel having superior fatigue properties when used in a corrosive or erosive environment, said stainless steel possessing a proof strength of 80 to 110 $kgf/mm^2$ and having a chemical composition consisting essentially of: 0.005 to 0.04 wt % of C, not more than 1.0 wt % of Si, not more than 2.0 wt % of Mn, 12.0 to 17.0 wt % of Cr, 3.0 to 6.0 wt % of Ni, 0.1 to 1.5 wt % of Mo, 0.02 to 0.5 wt % of V, 0.005 to 0.02 wt % of N, and not more than 0.01 wt % of Al, wherein the ratio of area occupied by non-metallic inclusions to the are of the cross-section of said steel cannot exceed 0.01%; whereby the number of loading cycles till rupture is greater than $10^5$ and the balance substantially Fe and incidental inclusions, the contents of C, Si, Mn, Cr, Ni, Mo, V, N and Al being determined such that a Ni equivalent Nieq given by the following formula (1) ranges between 10.5 and 12.9 wt %:

$$Nieq=[Ni]+[Mn]+0.5[Cr]+0.3[Si]+[Mo] \quad (1)$$

where, [N], [Mn], [Cr], [Si] and [Mo] respectively represent the contents of Ni, Mn, Cr, Si, and Mo in weight %, respectively.

2. A high strength martensitic stainless steel having superior fatigue properties when used in a corrosive or erosive environment, said stainless steel possessing a proof strength of 80 to 110 kgf/mm$^2$ and having a chemical composition consisting essentially of: 0.005 to 0.04 wt % of C, not more than 1.0 wt % of Si, not more than not more than 2.0 wt % of Mn, 12.0 to 17.0 wt % of Cr, 3.0 to 6.0 wt % of Ni, 0.1 to 1.5 wt % of Mo, 0.02 to 0.5 wt % of V, 0.005 to 0.02 wt % of N, and not more than 0.01 wt % of Al, wherein the ratio of area occupied by non-metallic inclusions to the are of the cross-section of said steel cannot exceed 0.01%; whereby the number of loading cycles till rupture is greater than $10^5$ one or both of 0.01 to 0.5 wt % of Nb and 0.2 to 2.0 wt % of Cu, and the balance substantially Fe and incidental inclusions, the contents of C, Si, Mn, Cr, Ni, Mo, V, N, Al, Nb, and Cu being determined such that a Ni equivalent Nieq given by the following formula (1') ranges between 10.5 and 12.9 wt %:

$$Nieq=[Ni]+[Mn]+0.5[Cr]+0.3[Si]+[Mo]+[Cu] \quad (1')$$

where, [Ni], [Mn], [Cr], [Si], [Mo] and [Cu] respectively represent the contents of Ni, Mn, Cr, Si, Mo and Cu in weight %, respectively.

3. A high-strength martensitic stainless steel according to claim 1 wherein the total content of C and N is not more than 0.05 wt % and wherein non-metallic inclusions are dispersed substantially uniformly so as to occupy 0.01% or less of the area of cross-section of said steel.

4. A high-strength martensitic stainless steel according to claim 2 wherein the total content of C and N is not more than 0.05 wt % and wherein non-metallic inclusions are dispersed substantially uniformly so as to occupy 0.01% or less of the area of cross-section of said steel.

5. A method of producing a high strength martensitic stainless steel of claim 1 possessing a proof strength of 80 to 110 kgf/mm$^2$ and having superior fatigue properties when used in a corrosive or erosive environment, comprising the steps of:

preparing a steel having a chemical composition consisting essentially of: 0.005 to 0.04 wt % of C, not more than 1.0 wt % of Si, not more than not more than 2.0 wt % of Mn, 12.0 to 17.0 wt % of Cr, 3.0 to 6.0 wt % of Ni, 0.1 to 1.5 wt % of Mo, 0.02 to 0.5 wt % of V, 0.005 to 0.02 wt % of N, and not more than 0.01 wt % of Al, and the balance substantially Fe and incidental inclusions, the contents of C, Si, Mn, Cr, Ni, Mo, V, N, and Al being determined such that an Ni equivalent Nieq given by the following formula (1) ranges between 10.5 and 12.9 wt %:

$$Nieq=[Ni]+[Mn]+0.5[Cr]+0.3[Si]+[Mo] \quad (1)$$

where, [Ni], [Mn], [Cr], [Si] and [Mo] respectively represent the contents of Ni, Mn, Cr, Si, and Mo in weight %, respectively;

subjecting said steel to a heating to a temperature of 1250° C. at the maximum;

subjecting the heated steel to a hot rolling at a rolling finish temperature of not less than 800° C.;

cooling the hot-rolled steel to a temperature not higher than 100° C. at a cooling rate which is not smaller than the cooling rate Vc (°C./min) which is computed in accordance with the following formula (2); and subjecting the cooled steel to a tempering or a quenching-tempering treatment:

$$Vc=2\times\{[Ni]+100([C]+[N])\} \quad (2)$$

where, [N], [C] and [N] respectively represent contents of Ni, V, N and Al in said steel.

6. A method of producing a high strength martensitic stainless steel of claim 2 possessing a proof strength of 80 to 110 kgf/mm$^2$ and having superior fatigue properties when used in a corrosive or erosive environment, comprising the steps of:

preparing a steel having a chemical composition consisting essentially of: 0.005 to 0.04 wt % of C, not more than 1.0 wt % of Si, not more than not more than 2.0 wt % of Mn, 12.0 to 17.0 wt % of Cr, 3.0 to 6.0 wt % of Ni, 0.1 to 1.5 wt % of Mo, 0.02 to 0.5 wt % of V, 0.005 to 0.02 wt % of N, and not more than 0.01 wt % of Al, one or both of 0.01 to 0.5 wt % of Nb and 0.2 to 2.0 wt % of Cu, and the balance substantially Fe and incidental inclusions, the contents of C, Si, Mn, Cr, Ni, Mo, V, N, Al, Nb and Cu being determined such that a Ni equivalent Nieq given by the following formula (1') ranges between 10.5 and 12.9 wt %:

$$Nieq=[Ni]+[Mn]+0.5[Cr]+0.3[Si]+[Mo]+[Cu] \quad (1')$$

where, [Ni], [Mn], [Cr], [Si], [Mo] and [Cu] respectively represent the contents of Ni, Mn, Cr, Si, Mo and Cu in weight %, respectively.

subjecting said steel to a heating to a temperature of 1250° C. at the maximum;

subjecting the heated steel to a hot rolling at a rolling finish temperature of not less than 800° C.;

cooling the hot-rolled steel to a temperature not higher than 100° C. at a cooling rate which is not smaller than the cooling rate Vc (°C./min) which is computed in accordance with the following formula (2); and subjecting the cooled steel to a tempering or a quenchingtempering treatment:

$$Vc=2\times\{[Ni]+100([C]+[N])\} \quad (2)$$

where, [Ni] [C] and [N] respectively represent contents of Ni, V, N and Al in said steel.

7. A method of producing a high strength martensitic stainless steel of claim 3 possessing a proof strength of 80 to 110 kgf/mm$^2$ and having superior fatigue properties when used in a corrosive or erosive environment, comprising the steps of:

preparing a steel having a chemical composition consisting essentially of: 0.005 to 0.04 wt % of C, not more than 1.0 wt % of Si, not more than not more than 2.0 wt % of Mn, 12.0 to 17.0 wt % of Cr, 3.0 to 6.0 wt % of Ni, 0.1 to 1.5 wt % of Mo, 0.02 to 0.5 wt % of V, 0.005 to 0.02 wt % of N, and not more than 0.01 wt % of Al, and the balance substantially Fe and incidental inclusions, the contents of C, Si, Mn, Cr, Ni, Mo, V, N, and Al being determined such that an Ni equivalent Nieq given by the following formula (1) ranges between 10.5 and 12.9 wt %, the total content of C and N being not more than 0.05 wt %, said steel having a structure in which non-metallic inclusions are dispersed uniformly to occupy not more than 0.01% of the area of a cross-section:

$$Nieq=[Ni]+[Mn]+0.5[Cr]+0.3[Si]+[Mo] \quad (1)$$

where, [Ni], [Mn], [Cr], [Si] and [Mo] respectively represent the contents of Ni, Mn, Cr, Si, and Mo in weight %, respectively;

subjecting said steel to a heating to a temperature of 1250° C. at the maximum;

subjecting the heated steel to a hot rolling at a rolling finish temperature of not less than 800° C.;

cooling the hot-rolled steel to a temperature not higher than 100° C. at a cooling rate which is not smaller than the cooling rate Vc (°C./min) which is computed in accordance with the following formula (2); and subjecting the cooled steel to a tempering or a quenching-tempering treatment:

$$Vc=2\times\{[Ni]+100([C]+[N])\} \quad (2)$$

where, [Ni], [C] and [N] respectively represent contents of Ni, V, N and Al in said steel.

8. A method of producing a high strength martensitic stainless steel of claim 4 possessing a proof strength of 80 to 110 kgf/mm$^2$ and having superior fatigue properties when used in a corrosive or erosive environment, comprising the steps of:

preparing a steel having a chemical composition consisting essentially of: 0.005 to 0.04 wt % of C, not more than 1.0 wt % of Si, not more than not more than 2.0 wt % of Mn, 12.0 to 17.0 wt % of Cr. 3.0 to 6.0 wt % of Ni, 0.1 to 1.5 wt % of Mo, 0.02 to 0.5 wt % of V, 0.005 to 0.02 wt % of N, and not more than 0.01 wt % of Al, one or both of 0.01 to 0.5 wt % of Nb and 0.2 to 2.0 wt % of Cu, and the balance substantially Fe and incidental inclusions, the contents of C, Si, Mn, Cr, Ni, Mo, V, N, Al, Nb and Cu being determined such that a Ni equivalent Nieq given by the following formula (1') ranges between 10.5 and 12.9 wt %, the total content of C and N being not more than 0.05 wt %, said steel having a structure in which non-metallic inclusions are dispersed uniformly to occupy not more than 0.01% of the area of a cross-section:

$$Nieq=[Ni]+[Mn]+0.5[Cr]+0.3[Si]+[Mo]+[Cu] \quad (1')$$

where, [Ni], [Mn], [cr], [Si], [Mo] and [Cu] respectively represent the contents of Ni, Mn, Cr, Si, Mo and Cu in weight %, respectively;

subjecting said steel to a heating to a temperature of 1250° C. at the maximum;

subjecting the heated steel to a hot rolling at a rolling finish temperature of not less than 800° C.;

cooling the hot-rolled steel to a temperature not higher than 100° C. at a cooling rate which is not smaller than the cooling rate Vc (°C./min) which is computed in accordance with the following formula (2); and subjecting the cooled steel to a tempering or a quenchingtempering treatment:

$$Vc=2\times\{[Ni]+100([C]+[N])\} \quad (2)$$

where, [Ni], [C] and [N] respectively represent contents of Ni, V, N and Al in said steel.

9. A foil of a hydrofoil made of a high-strength martensitic stainless steel of claim 1.

10. A foil of a hydrofoil made of a high-strength martensitic stainless steel of claim 2.

11. A foil of a hydrofoil made of a high-strength martensitic stainless steel of claim 3.

12. A foil of a hydrofoil made of a high-strength martensitic stainless steel of claim 4.

* * * * *